US010066517B2

(12) United States Patent
Kretschmer et al.

(10) Patent No.: US 10,066,517 B2
(45) Date of Patent: Sep. 4, 2018

(54) SUPPORT ELEMENT

(71) Applicant: Schaeffler Technologies AG & Co. KG, Herzogenaurach (DE)

(72) Inventors: Jurgen Kretschmer, Furth (DE); Peter Sailer, Erlangen (DE); Wolfgang Christgen, Seukendorf (DE); Michael Kugler, Vestenbergsgreuth (DE); Jochen Tovar, Kirchehrenbach (DE); Max Schafer, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 137 days.

(21) Appl. No.: 15/308,994

(22) PCT Filed: Mar. 31, 2015

(86) PCT No.: PCT/DE2015/200224
§ 371 (c)(1),
(2) Date: Nov. 4, 2016

(87) PCT Pub. No.: WO2015/197056
PCT Pub. Date: Dec. 30, 2015

(65) Prior Publication Data

US 2018/0187576 A1 Jul. 5, 2018

(30) Foreign Application Priority Data

Jun. 26, 2014 (DE) ..... 10 2014 212 272

(51) Int. Cl.
*F01L 1/46* (2006.01)
*F01L 1/24* (2006.01)
(Continued)

(52) U.S. Cl.
CPC ..... *F01L 1/2405* (2013.01); *F01L 1/14* (2013.01); *F01L 1/46* (2013.01); *F01L 13/0005* (2013.01); *F01L 2001/2444* (2013.01)

(58) Field of Classification Search
CPC ... F01L 1/14; F01L 1/24; F01L 1/2405; F01L 1/2411; F01L 1/2422; F01L 1/46
(Continued)

(56) References Cited

U.S. PATENT DOCUMENTS 6,959,677 B2 11/2005 Mayer et al.
2005/0193973 A1* 9/2005 Hendriksma ..... F01L 1/2405 123/90.55

(Continued)

FOREIGN PATENT DOCUMENTS

DE 19805511 8/1999
DE 10330510 1/2005

(Continued)

*Primary Examiner* — Jorge Leon, Jr.
(74) *Attorney, Agent, or Firm* — Volpe and Koenig, P.C.

(57) ABSTRACT

A double-flow hydraulic support element for a switchable finger lever of a valve train of an internal combustion engine is provided. A piston is arranged in an axial bore of the housing of the support element in an axially movable manner, and the piston includes a hollow cylindrical pressure part and a cup-shaped working part. A head of the pressure part is used as a support for the finger lever and projects beyond the housing edge, and an opening for the flow of a hydraulic medium is formed in the end face of the head. The housing has a first passage and a second passage axially spaced from the first passage for the hydraulic medium. The support element has a hydraulic play compensation device with a ball non-return valve for the finger lever. In order to achieve an optimal actuation of the coupling element, a sleeve which is closed on one side is inserted into the pressing part; the closed end of the sleeve reaches the region of an outer annular groove in a sealing (Continued)

manner below the dome-shaped head of the pressing part; a storage space for supplying the play compensation device with the hydraulic medium is formed radially within and axially outside of the sleeve, in the pressure part, and in the working part of the piston; the storage space is connected to the first passage in the housing via a passage opening in the working part; an actuation space formed between the sleeve and the pressure part of the piston for hydraulically supplying the coupling device is connected to the second passage in the housing via a radial passage opening in the pressure part; and the volume of the storage space is substantially greater than the volume of the actuation space.

11 Claims, 1 Drawing Sheet

(51) Int. Cl.
*F01L 13/00* (2006.01)
*F01L 1/14* (2006.01)

(58) Field of Classification Search
USPC ..... 123/90.43, 90.46, 90.55
See application file for complete search history.

(56) References Cited

U.S. PATENT DOCUMENTS

2010/0037845 A1* 2/2010 Sailer ..... F01L 1/2405 123/90.55
2014/0283776 A1* 9/2014 Smith ..... F01L 1/2416 123/90.46

FOREIGN PATENT DOCUMENTS

DE 102004006903 9/2005
DE 10206045017 3/2008
EP 1143120 10/2001
EP 1568851 8/2005

* cited by examiner

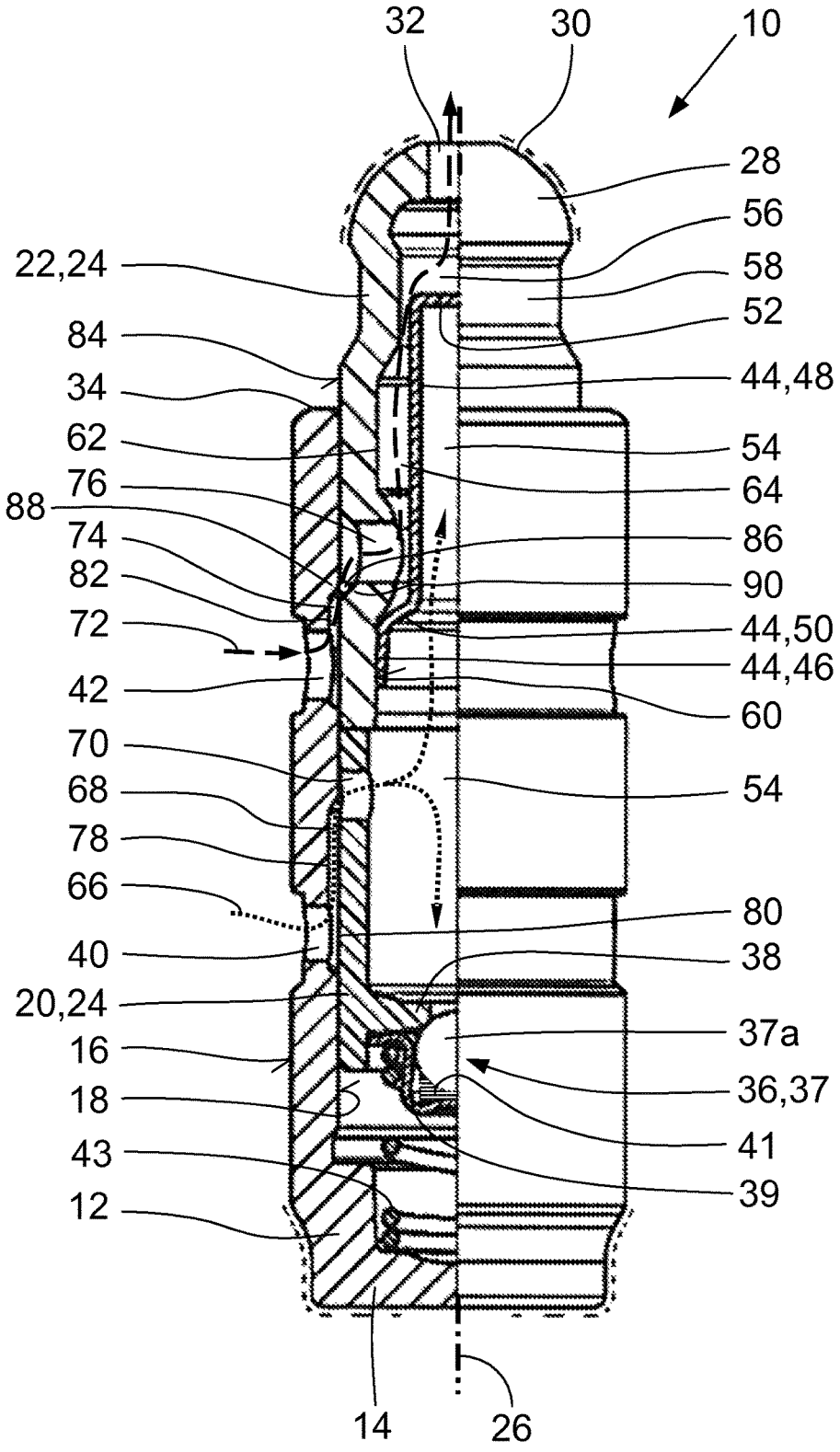
32
30
10
28
56
58
52
44,48
54
64
86
90
44,50
44,46
60
54
80
38
37a
36,37
41
39
22,24
84
34
62
76
88
74
82
72
42
70
68
78
66
40
20,24
16
18
43
12
14
26

SUPPORT ELEMENT

BACKGROUND

The invention relates to a double flow hydraulic support element for a switchable finger lever of a valve train of an internal combustion engine, with a pot-shaped housing that can be installed in a cylinder head of an internal combustion engine, in which a piston is arranged so that it can move axially in an axial hole of the housing coaxial to the longitudinal center axis of the support element, in which the piston is formed of a hollow cylindrical pressure part and a pot-shaped work part connecting axially to this pressure part, in which at least one head of the pressure part of the piston is used as a support for the switchable finger lever and projects axially past a housing edge, in which an opening for the flow of a hydraulic medium is formed in the end side of the head of the piston for loading a hydraulically controllable coupling device in the switchable finger lever, in which the housing has a first radial passage and, axially spaced apart from this first passage, a second radial passage for hydraulic medium, and in which a hydraulic play compensation device for the finger lever is formed on the support element, wherein this play compensation device has a ball retaining valve.

From DE 103 30 510 A1, a double-flow support element for a switchable finger lever of a valve train of an internal combustion engine is known that has two separate flow paths for a hydraulic medium in a housing. The first flow path is used for supplying a hydraulic play compensation device, while the supply of coupling means in a contacting, switchable finger lever with the hydraulic medium is realized via the second flow path. The hydraulic separation of the two flow paths takes place by means of a cap-shaped element that is inserted into a hollow pressure piston of the support element. A retaining valve within the hydraulic play compensation device is formed with a ball that closes a hole in a bottom of a work piston in the closed position of the retaining valve. A valve spring presses the ball axially with a defined mechanical pretensioning force against the open end of the hole in the piston bottom, wherein the valve spring is supported between the ball and a pot-shaped cap. A radially outward directed flange of the pot-shaped cap contacts with a defined force on a bottom-side, axial recess of the work piston, wherein a compression spring is supported between the flange of the cap and a bottom surface of a cylindrical space of the housing of the support element for generating the necessary contact force.

A similar support element is known from DE 10 2006 045 017 A1. A disadvantage in these support elements is that a relatively large dead volume for holding hydraulic medium is formed above the cap-shaped element. This leads to a non-optimal response behavior of the coupling means in the finger lever and associated with this relatively imprecise control times in the valve train.

In addition, from DE 10 2004 006 903 A1, a one-flow hydraulic support element is known, with which merely play compensation can be realized hydraulically on a non-switchable finger lever. This play compensation also functions using a ball retaining valve that is arranged in the axial lower region of the hydraulic support element and is loaded with hydraulic medium from a storage space in the support element. The storage space is limited in this support element by a deflection sleeve that is arranged coaxially in an axially extending hollow space of the pressure piston of the support element and is fixed with a larger-diameter section on the inner lateral surface of this part. On the smaller-diameter axial end, the deflection sleeve has an inlet opening for hydraulic medium. The supply of the storage space with hydraulic medium is realized by a radial hole in the housing and a radial hole in the pressure piston of the hydraulic support element. From there, the hydraulic medium reaches via a hollow cylindrical rising path that is formed between the outer wall of the deflection sleeve and the inner wall of the pressure piston to the inflow opening away from the retaining valve in the deflection sleeve and from there into the storage space. In the axial area of the deflection sleeve, a radial ventilation hole is formed in the pressure piston. The functioning of this hydraulic support element can be found in DE 10 2004 006 903 A1 in that, after the inflow of the hydraulic medium via the radial hole in the housing and the radial hole in the pressure piston, this medium comes into the hollow cylindrical rising path. A first part of the air possibly contained in the supplied hydraulic medium is discharged into the open via the radial ventilation hole. The supplied hydraulic medium then goes via the axial opening in the deflection sleeve into the storage space that is radially limited via a relatively long axial area from the deflection sleeve. The hydraulic medium collected there is already relatively calm there and free from bubbles. This lies primarily in that the hydraulic medium in this part of the storage space is not swirled up by other inflowing hydraulic medium. If hydraulic medium fed via the rising path into the inner space of the deflection sleeve still contains air bubbles, these air bubbles rise upward into the area of the head of the support element and thus do not influence the relatively calm hydraulic medium directly in front of the retaining valve. The axially relatively long deflection sleeve is used in this one-flow support element accordingly in order to provide a ventilation and calming section, the so-called rising path, for the hydraulic medium that can be fed to the retaining valve.

SUMMARY

With this background, the invention is based on the objective of providing a two-flow hydraulic support element in which a hydraulic play compensation device can be supplied by a first flow path and the coupling means can be supplied by a second flow path for a switchable finger lever contacting the support element with a hydraulic medium. The novel support element should enable an especially precise and delay-free control of the coupling means of the finger lever.

This object is achieved by a two-flow hydraulic support element with the features of the main claim. Advantageous constructions are given in the subordinate claims.

The invention starts from the knowledge that undesired delay times in the actuation of actuation elements in a hydraulic system can be reduced by reducing the volumes of the hydraulic circuits involved in the control.

The invention consequently relates to a two-flow hydraulic support element for a switchable finger lever of a valve train of an internal combustion engine, with a pot-shaped housing that can be installed in a cylinder head of an internal combustion engine, in which a piston is arranged so that it can move axially in an axial hole of the housing coaxial to the longitudinal center axis of the support element, in which the piston is made from a hollow cylindrical pressure part and a pot-shaped work part axially contacting this pressure part, in which at least one head of the pressure part of the piston is used as a support for the switchable finger lever and projects axially past a housing edge, in which, in the end side of the head of the piston, an opening for the flow of a hydraulic medium is formed for loading a hydraulically controllable coupling device in the switchable finger lever, in which the housing has a first radial passage and axially spaced apart from this first passage a second radial passage for hydraulic medium, and in which a hydraulic play compensation device is formed for the finger lever on the support element, wherein this play compensation device has a ball retaining valve.

To achieve the objective, in this support element it is also provided that a sleeve closed on one side is inserted so that it cannot move into the pressure part of the piston, the closed end of the sleeve reaches into the area of an outer ring groove sealed underneath the dome-shaped head of the pressure part, a common storage space for supplying the play compensation device with the hydraulic medium is formed radially within the sleeve and axially underneath the sleeve in the pressure part and also in the contacting work part of the piston, the storage space is connected to the first passage in the housing via a radial passage opening in the work part of the piston via a first hydraulic path, a control space formed between the radial outer side of the sleeve and the radial inner side of the pressure part of the piston for the hydraulic supply of the coupling device in the switchable finger lever is connected via a radial passage opening in the pressure part of the piston to the second passage in the housing via a second hydraulic path, and the volume of the storage space is essentially larger than the volume of the control space.

Through the present construction, two hydraulic flow paths are given that are isolated from each other and separately supply the play compensation device and the coupling means of the finger lever with hydraulic medium. Through the comparatively very small volume of the control space, a very short response delay time period is achieved in the actuation of the coupling device in the switchable finger lever, so that very short and precise control times can be realized at low rotational speeds of the internal combustion engine.

According to one advantageous construction of the support element, it is provided that the sleeve has a first and a second hollow cylindrical section that each have a different diameter and are connected and also spaced apart from each other by an offset section. In this way the sleeve can fulfill multiple functions.

Thus, according to one refinement of this support element it can be provided that the first section of the sleeve forms a hydraulically sealed contact on a radial inner surface of the pressure part of the piston and an annular space is formed between the second section of the sleeve and an axial section of the inner surface of the pressure part of the piston. In this way, a mechanically fixed and hydraulically sealed closed seating of the sleeve in the head part of the piston is achieved, wherein a hydraulic connection between the second radial passage opening in the piston and also the axial opening in the head of the pressure part of the piston is created.

Corresponding to another refinement of the support element, it is provided that the first radial passage in the housing is hydraulically connected to the radial passage opening in the work part of the piston by a first ring gap between the housing and work part. In this coaxial ring gap, the hydraulic medium is calmed and vented, so that foaming is largely prevented. Through the coaxial ring gap, a sufficient flow cross section for the hydraulic medium is simultaneously given for its continued flow to the storage space for a simultaneously small radial installation space requirement.

According to a different construction it is provided that the described first ring gap is formed by a first radial widening of the hole of the housing and a cylindrical outer surface of the work part. The construction of the first ring gap can be realized in a simple way by a cutting process of an initially continuous cylindrical inner surface of the housing of the support element.

According to another embodiment it is provided that the second radial passage in the housing is hydraulically connected to the radial passage opening in the pressure part by means of a second ring gap between the housing and pressure part of the piston. In this way, a path for calming and venting the hydraulic medium is also given in the second hydraulic path.

The second ring gap is preferably formed by a second radial widening of the hole of the housing and a cylindrical outer surface of the pressure part of the piston. This second ring gap can also be generated by a cutting process of an initially continuous cylindrical inner surface of the housing of the support element.

According to another refinement of the support element it is provided that the first passage in the housing and the radial passage opening in the work part of the piston as well as the second passage in the housing and the radial passage opening in the pressure part of the piston are arranged axially offset relative to each other without axial overlap. In this way, the flow rate of the hydraulic medium can be reduced.

Preferably, a securing ring is arranged between a shoulder formed on the hole of the housing and a shoulder formed on the outer surface of the pressure part. Here, an axial path limitation or an axial stop for the pressure part of the piston is given within the housing. The securing ring is here created so that an essentially unlimited passage of the hydraulic medium is possible or the second flow path for the hydraulic medium remains essentially unimpaired.

Finally, it is considered advantageous if it is provided that the volume of the storage space formed between the inner sides of the sleeve, the pressure part, and the work part of the piston is greater by at least 50% than the volume of the control space formed between the outer side of the sleeve and the inner side of the pressure part of the piston. In a limiting way it can be provided here that the volume of the storage space formed between the inner sides of the sleeve, the pressure part, and the work part of the piston is greater by 50% to 180% than the volume of the control part formed between the outer side of the sleeve and the inner side of the pressure part of the piston. According to one example embodiment it is provided that the volume of the storage space is greater by 60% to 80% than the volume of the control space. In an extremely limiting way, it is provided that the volume of the storage space is greater by 65% to 75% than the volume of the control space.

BRIEF DESCRIPTION OF THE DRAWINGS

For the further explanation of the invention, a drawing of an embodiment accompanies the description. The sole FIGURE shows a radial partial longitudinal section through a support element constructed according to the invention.

DETAILED DESCRIPTION OF THE PREFERRED EMBODIMENTS

The hydraulic support element 10 has an essentially pot-shaped housing 12 with a housing bottom 14 and an outer lateral surface 16. The housing 12 can be inserted into a hole of a not-shown cylinder head of an internal combustion engine. Hydraulic channels that supply the hydraulic support element 10 with a hydraulic medium open into the hole in the cylinder head. An axially assembled piston 24 made from a work part 20 and a pressure part 22 is held so that it can move axially along a longitudinal center axis 26 of the support element 10 in an axially continuous cylindrical hole 18 of the housing 12. The work part 20 is here gap-free and contacts the pressure part 22 of the piston 24 axially in impact.

A dome-shaped head 28 of the pressure part 22 of the piston 24 is used as a support for a not-shown finger lever of a similarly not-shown valve train of an internal combustion engine. In the end side 30 of the dome-shaped head 28 of the pressure part 22 of the piston 24 there is an opening that is constructed as cylindrical hole 32 and is used for supplying a hydraulic medium for controlling a hydraulically actuatable coupling device of the finger lever. In order to guarantee a sufficient axial actuation path, at least the dome-shaped head 28 extends past an axial housing edge 34 of the support element 10.

In order to enable the desired automatic valve play compensation of the valve train of the internal combustion engine, in the support element 10 an automatically hydraulically acting play compensation device 36 is formed in the area of a bottom 38 of the work part 20 of the piston 24. This play compensation device 36 has only a partially recognizable ball retaining valve 37, whose ball 37*a* contacts a valve seat that is formed in the area of an axial hole in the bottom 38 of the work part 20 of the piston 24. The ball 37*a* is pressed by a retaining cap 39 and a valve spring 41 against the valve seat. A cylindrical compression spring 43 supported axially on the work part 20 of the piston 24 and the housing bottom 14 acts on the retaining cap 39 itself.

In the housing 12 there are also a first radial passage 40 and a second radial passage 42 for the passage of the hydraulic means that can be a hydraulic oil or the like. The two radial passages 40, 42 are arranged with a relatively large axial spacing relative to each other.

Within the pressure part 22 of the piston 24 there is a sleeve 44 that is closed on one side and has a first section 46 and a second section 48 that are connected to each other by a conical offset section 50. The first section 46 and the second section 48 of the sleeve 44 each have a hollow cylindrical shape, wherein the not-designated diameter of the first section 46 is greater than the diameter of the second section 48. The length of the second section 48 of the sleeve 44 is at least three times as large as a length of the first section 46 of the sleeve 44. The sleeve 44 is formed closed on its upper end 52 away from the retaining valve.

The inner space of the sleeve 44, an axial short section of the radially inner space of the pressure part 22 and the radially inner space of the work part 20 of the piston 24 form a storage space 54 for holding hydraulic medium. Through the sleeve 44, the storage space 54 is separated hydraulically from a control space 56 that is formed between the radial outer side of the sleeve 44 and an axial section 62 of the inner surface 60 of the pressure part 22 of the piston 24.

By use of the two mentioned passages 40, 42 in the housing 12, the storage space 54 and the control space 56 can be supplied with hydraulic medium. The closed end 52 of the sleeve 44 here extends into the area of an outer, circumferential ring groove 58 on the pressure part 22 of the piston 24 sealed underneath the dome-shaped head 28, wherein the control space 56 has, in comparison to the storage space 54, a considerably smaller volume. The supply of the automatic play compensation device 36 with hydraulic medium is realized via the storage space 54, while the control space 56 isolated hydraulically from the storage space is used for feeding the switchable coupling element allocated to the finger lever in the valve train of the internal combustion engine.

The first axial section 46 of the sleeve 44 preferably forms a press-fit and largely hydraulically sealed contact on the cylindrical inner surface 60 of the pressure part 22 of the piston 24 and is in this way simultaneously fixed in position axially. In contrast, a narrow radial ring space 64 in which the inflow hydraulic medium can be calmed remains between the second axial section 48 of the sleeve 44 and an axial section 62 of the inner surface 60 of the pressure part 22. In a clearly recognizable way, the radial outer side of the second axial section 48 of the sleeve 44 extends close to the inner wall of the pressure part 22 of the piston 24, so that this area of the control space 56 close to the work piston has only a very small volume.

A first hydraulic path 66 for feeding hydraulic medium runs through the first radial passage 40 of the housing 12 via a first ring gap 68 and a radial passage opening 70 in the work part 20 of the piston 24 runs into the large-volume storage space 54. A second hydraulic path 72 independent of the first path runs from the second radial passage 42 of the housing 12 via a second ring gap 74 and a radial passage opening 76 in the pressure part 22 of the piston 24 into to the small-volume control space 56 formed outside of the sleeve 44. The two radial passages 40, 42 in the housing 12 are fed via not-shown channels in the cylinder head of the internal combustion engine with the hydraulic medium usually pressurized unequally.

The first ring gap 68 is formed between a first radial recess 78 in the hole 18 of the housing 12 and an outer surface 80 of the pot-shaped work part 20 of the piston 24. The second ring gap 74 is formed between a second radial recess 82 in the hole 18 of the housing 12 and a cylindrical outer surface 84 of the pressure part 22 of the piston 24.

The first passage 40 and the second passage 42 in the housing 12 and the two radial passage openings 70, 76 in the work part 20 or in the pressure part 22 of the piston 24 are each arranged axially offset relative to each other with respect to the longitudinal center axis 26. A securing ring 86 is used for the axial position securing or as axial path limiting for the piston 24 and is arranged between a shoulder 88 formed on the hole 18 of the housing 12 and another shoulder 90 formed on the outer surface 84 of the pressure part 22. The securing ring 86 is arranged in the second hydraulic path 72 and formed so that the hydraulic medium can flow around it largely free from resistance. The securing ring 86 can be constructed, for example, as a spring ring or snap ring.

Due to the construction according to the invention of the two-flow hydraulic support element 10 with its axially very long and large-diameter sleeve 44, a relatively large-volume storage space 54 is produced for supplying the play compensation device 36 and a relatively small control space 56 with a significantly reduced space content in comparison with known two-flow hydraulic support elements. The control space 56 is used independently from the storage space 54 only for supplying the switchable coupling element of the finger lever of the valve train of the internal combustion engine. In this way, an unavoidable dead volume in the hydraulic path for controlling the switchable coupling element of the finger lever is significantly reduced in comparison to known technical solutions, wherein this arrangement enables precise and very short control times for the valve train.

Due to the simultaneously increased storage space 54 in terms of volume, the functionality of the play compensation device 36 of the support element 10 is also provided even if this is located in an inclined position due to the vehicle being inclined in comparison with its vertical orientation shown here.

LIST OF REFERENCE NUMBERS

10 Hydraulic support element
12 Pot-shaped housing
14 Housing bottom
16 Outer lateral surface of the housing
18 Cylindrical hole in the housing
20 Work part of the piston
22 Pressure part of the piston
24 Piston
26 Longitudinal center axis
28 Head on the pressure part of the piston
30 End side of the head
32 Hole in the head
34 Housing edge
36 Play compensation device
37 Ball retaining valve
37*a* Ball
38 Bottom of the work part of the piston
39 Holding cap
40 First radial passage in the housing
41 Valve spring
42 Second radial passage in the housing
43 Compression spring
44 Sleeve
46 First section of the sleeve
48 Second section of the sleeve
50 Conical offset section of the sleeve
52 Closed end of the sleeve
54 Storage space
56 Control space
58 Annular groove in the work part of the piston sealed underneath the head
60 Inner surface in the pressure part of the piston
62 Axial section of the piston
64 Annular space between the piston and sleeve
66 First hydraulic path
68 First ring gap
70 Radial passage opening in the work part of the piston
72 Second hydraulic path
74 Second ring gap
76 Radial passage opening in the pressure part of the piston
78 First radial widening of the hole in the housing
80 Cylindrical outer surface of the work part of the piston
82 Second radial widening of the hole in the housing
84 Cylindrical outer surface in the pressure part of the piston
86 Securing ring
88 Shoulder in the hole of the housing
90 Shoulder on the outer surface of the pressure part

The invention claimed is:

1. A double-flow hydraulic support element for a switchable finger lever of a valve train of an internal combustion engine, the support element comprising:

a pot-shaped housing that is installable in a cylinder head of the internal combustion engine, a piston arranged to move axially in an axial hole of the housing coaxial to a longitudinal center axis of the support element, the piston comprises a hollow cylindrical pressure part and a pot-shaped work part connected axially to said pressure part, a head of the pressure part of the piston is used as a support for the switchable finger lever and projects axially past a housing edge, an opening is formed in an end side of the head of the piston for flow of a hydraulic medium for loading a hydraulically controllable coupling device in the switchable finger lever, the housing has a first radial passage and axially spaced apart from said first radial passage is a second radial passage for hydraulic medium, a hydraulic play compensation device for the switchable finger lever is formed on the support element, said play compensation device has a ball retaining valve, a sleeve closed on one side is inserted and fixed in the pressure part of the piston, a closed end of the sleeve extends into an area of an outer ring groove sealed underneath the head of the pressure part, a common storage space for supplying the play compensation device with the hydraulic medium is formed radially within the sleeve and axially underneath the sleeve in the pressure part and also in the work part of the piston, the storage space is connected by a first radial passage opening in the work part of the piston to the first radial passage in the housing by a first hydraulic path, a control space formed between a radial outer side of the sleeve and a radial inner side of the pressure part of the piston for the hydraulic supply of the coupling device in the switchable finger lever is connected by a second radial passage opening in the pressure part of the piston to the second radial passage in the housing by a second hydraulic path, and a volume of the storage space is larger than a volume of the control space.

2. A support element according to claim 1, wherein the sleeve has first and second hollow cylindrical sections that each have a different diameter and are connected to each other and spaced apart from each other by an offset section.

3. The support element according to claim 2, wherein the first hollow cylindrical section of the sleeve forms a hydraulically sealed contact with a radial inner surface of the pressure part of the piston, and an annular space is formed between the second hollow cylindrical section of the sleeve and an axial section of the radial inner surface of the pressure part of the piston.

4. The element according to claim 1, wherein the first radial passage is connected hydraulically in the housing to the first radial passage opening in the work part of the piston by a first ring gap between the housing and work p art.

5. The support element according to claim 4, wherein the first ring gap is formed by a first radial widening of the axial hole of the housing and a cylindrical outer surface of the work part.

6. The support element according to claim 5, wherein the second radial passage is connected hydraulically in the housing to the second radial passage opening in the pressure part of the piston by a second ring gap between the housing and pressure part.

7. The support element according to claim 6, wherein the second ring gap is formed by a second radial widening of the axial hole of the housing and a cylindrical outer surface of the pressure part.

8. The support element according to claim 1, wherein the first radial passage in the housing and the first radial passage opening in the work part of the piston and the radial second passage in the housing and the second radial passage opening in the pressure part of the piston are each offset axially relative to each other without axial overlap.

9. The support element according to claim 1, further comprising a securing ring arranged between a shoulder formed on the axial hole of the housing and a shoulder formed on an outer surface of the pressure part.

10. The support element according to claim 1, wherein the volume of the storage space is greater than the volume of the control space by at least 50%.

11. The support element according to claim 10, wherein the volume of the storage space is greater than the volume of the control space by 50% to 180%.

* * * * *